US005229561A

United States Patent [19]

Seki et al.

[11] Patent Number: 5,229,561

[45] Date of Patent: Jul. 20, 1993

[54] PUFFER-TYPE GAS CIRCUIT BREAKER

[75] Inventors: Yasuharu Seki; Masanori Tsukushi; Akira Hashimoto; Yukio Kurosawa, all of Hitachi, Japan

[73] Assignee: Hitachi, Ltd., Tokyo, Japan

[21] Appl. No.: 838,335

[22] Filed: Feb. 20, 1992

[30] Foreign Application Priority Data

Mar. 13, 1991 [JP] Japan ..... 3-072075

[51] Int. Cl.[5] ..... H01H 33/88; H01H 33/91

[52] U.S. Cl. ..... 200/148 A; 200/148 R

[58] Field of Search ..... 200/148 R, 148 A, 150 G

[56] References Cited

U.S. PATENT DOCUMENTS

| | | | |
|---|---|---|---|
| 3,996,439 | 12/1976 | Tokuyama et al. | 200/148 A |
| 4,754,109 | 6/1988 | Thuries et al. | 200/148 A |
| 4,939,322 | 7/1990 | Kashimura et al. | 200/148 A |
| 5,072,084 | 12/1991 | Seki et al. | 200/148 A |
| 5,079,391 | 1/1992 | Koyanagi et al. | 200/148 A |

FOREIGN PATENT DOCUMENTS

| | | |
|---|---|---|
| 62-31772 | 7/1987 | Japan . |
| 2-129820 | 5/1990 | Japan . |

*Primary Examiner*—J. R. Scott

*Attorney, Agent, or Firm*—Antonelli, Terry, Stout & Kraus

[57] ABSTRACT

A puffer type gas circuit breaker includes arc extinguishing gas filled in the interior of the gas circuit breaker, fixed contact, a movable contact disposed in an opposed relationship with respect to the fixed contact so as to come into contact therewith, a fixed piston and a drive shaft slidably extends through the fixed piston, and drives the movable contact toward and away from the fixed contact. A puffer cylinder is slidably fitted on the fixed piston, with the puffer cylinder cooperating with the fixed piston to define a puffer chamber, within the puffer cylinder. An outer cylinder is mounted on an outer periphery of the puffer cylinder to form a thermal puffer chamber outside the puffer cylinder. A cover covers an outer surface of the movable contact, with a first insulating nozzle surrounding the cover to form a first gas flow passage for guiding the arc extinguishing gas from the puffer chamber to an arc generating portion. A second insulating nozzle surrounds the first insulating nozzle to form a second gas flow passage for guiding the arc extinguishing gas from the thermal puffer chamber to the arc generating portion.

15 Claims, 7 Drawing Sheets

PUFFER-TYPE GAS CIRCUIT BREAKER

BACKGROUND OF THE INVENTION

This invention relates generally to a gas circuit breaker, and, more particularly, to a puffer-type gas circuit breaker having a puffer chamber and a thermal puffer chamber.

There has been proposed a puffer-type gas circuit breaker which includes a puffer chamber for compressing an arc extinguishing gas for blow-out in connection with the interrupting operation, and a thermal puffer chamber for increasing the pressure of the arc extinguishing gas for blow-out by the energy of an arc produced when contacts are apart from each other. Such a puffer-type gas circuit breaker is disclosed, for example, in Japanese Patent Unexamined Publication No. 2-12982, and this circuit breaker is shown in FIG. 14.

The puffer-type gas circuit breaker of FIG. 14 comprises a fixed contact 1, a movable contact 2 disposed in an opposed relationship with respect to fixed contact 1 so as to come into contact therewith, a drive shaft 11 for driving the movable contact 2 toward and away from the fixed contact 1, a fixed piston 12, a puffer cylinder 13, slidably fitted on the fixed piston 12, and first and second insulating nozzles 5 and 6 connected to the puffer cylinder 13 and surrounding the movable contact 2. The fixed piston 12, the drive shaft 11 and the puffer cylinder 13 cooperate with one another to define a puffer chamber 7 within the puffer cylinder 13. A second gas flow passage 18*b* is formed between the first and second insulating nozzles 5 and 6, and is in communication with a thermal puffer chamber 8. The thermal puffer chamber 8 is separated from the puffer chamber 7 by a partition member 25 provided inside the puffer cylinder 13 A first gas flow passage 18*a* is formed between the movable contact 2 and the first insulating nozzle 5 and also between the movable contact 2 and the partition member 25. The first gas flow passage 18*a* is in communication with the puffer chamber 7.

When the drive shaft 11 is driven to the right in FIG. 14, the movable contact 2 is brought out of contact with the fixed contact 1, so that an arc 16 is produced between these two contacts In connection with this rightward movement of the drive shaft 11, the arc extinguishing gas within the puffer chamber 7 is compressed into a high pressure. Also, the arc extinguishing gas within the thermal puffer chamber 8 is heated by the thermal energy of the arc 16, and therefore is brought to a high pressure.

Then, the highly-pressurized arc extinguishing through the first gas flow passage 18*a*, and also the highly-pressurized arc extinguishing gas within the thermal puffer chamber 8 is blown onto the arc 16 through the second gas flow passage 18*b*, thereby effecting the arc extinguishing operation.

If the above puffer-type gas circuit breaker is so designed that a medium and a small electric current can be mainly interrupted by the blowing of the arc extinguishing gas from the puffer chamber 7 and that large electric current can be mainly interrupted by the blowing of the arc extinguishing gas from the thermal puffer chamber 8, the circuit breaker can be of a compact construction.

However, if the volume of the thermal puffer chamber 8 is increased in order to enhance the interrupting performance and particularly the large current-interrupting performance, the space of the puffer chamber 7 that can be utilized for the compression is naturally reduced as is clear from FIG. 14, and this lowers the pressure rising characteristics of the puffer chamber 7. The pressure rising characteristics can be maintained by increasing the volume of the puffer chamber 7. Namely, this can be achieved by increasing the diameter of the puffer cylinder 13. With such a construction, however, the pressure receiving area of the puffer cylinder 13 increases, which results in a drawback that the operating force for driving the drive shaft 11 is increased.

SUMMARY OF THE INVENTION

It is therefore an object of this invention to provide a puffer-type gas circuit breaker which can enhance an electric current interrupting performance without lowering pressure rising characteristics of a puffer chamber.

Another object of the invention is to provide a puffer-type gas circuit breaker in which a puffer chamber and a thermal puffer chamber can be set to respective desired volumes independently of each other, so that an electric current interrupting performance can be set arbitrarily.

A further object of the invention is to provide a puffer-type gas circuit breaker in which an electric current interrupting performance can be enhanced without increasing an interruption operating force.

According to the present invention, there is provided a puffer-type gas circuit breaker comprising arc extinguishing gas filled in the interior of the gas circuit breaker, a fixed contact, a movable contact, disposed in an opposed relationship with respect to the fixed contact so as to come into contact therewith. A drive shaft slidably extends through the fixed piston, and drives the movable contact toward and away from the fixed contact. A puffer cylinder is slidably fitted on the fixed piston, with the puffer cylinder cooperating with the fixed piston to define a puffer chamber within the puffer cylinder. An outer cylinder is mounted on an outer periphery of the puffer cylinder to form a thermal puffer chamber outside the puffer cylinder. A cover covers an outer surface of the movable contact with a first insulating nozzle surrounding the cover to form a first gas flow passage for guiding the arc extinguishing gas from the puffer chamber to an arc generating portion. A second insulating nozzle surrounds the first insulating nozzle so as to form a second gas flow passage for guiding the arc extinguishing gas from the thermal puffer chamber to the arc generating portion.

Preferably, the distance of the first gas flow passage in the direction of the axis of the fixed contact is less than the distance of the second gas flow passage in the direction of the axis of the fixed contact.

The first and second insulating nozzles have their respective throat portions surrounding the fixed contact, and, preferably, the diameter of the throat portion of the first insulating nozzle is greater than the diameter of the throat portion of the second insulating nozzle.

A small hole or holes communicating the puffer chamber with the thermal puffer chamber may be formed through a peripheral wall of the puffer cylinder.

A cooling fin or fins may be provided within the thermal puffer chamber in the vicinity of the small holes.

There may be provided a plurality of gas discharge passages which communicate the interior of the movable contact with the exterior of the outer cylinder, and a discharge guide may be provided at outlets of the gas discharge passages The discharge guide closes the outlets until the throat portion of the second insulating nozzle comes out of the fixed contact.

Preferably, the cover, the first insulating nozzle and the second insulating nozzle are integrally molded into a unitary construction.

DESCRIPTION OF THE PREFERRED EMBODIMENTS

Figure 1:
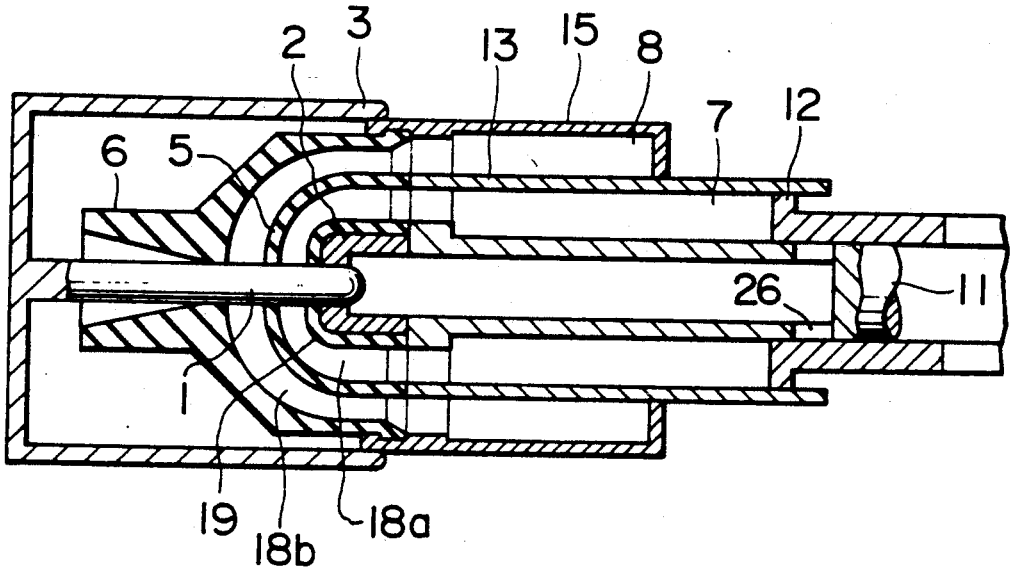
FIG. 1 is a longitudinal cross-sectional view of a first embodiment of a puffer-type gas circuit breaker according to the present invention, in a closed condition of the gas circuit breaker.

A first embodiment of a puffer-type gas circuit breaker according to the present invention will now be described with reference to FIGS. 1 to 4.

An arc extinguishing gas is filled in the interior of the puffer-type gas circuit breaker. A movable contact 2 is disposed in an opposed relationship with respect to a fixed contact 1 so as to come into contact therewith, and the movable contact 2 is carried by a drive shaft 11 having vent holes 26. A fixed piston 12 is provided on that side of the movable contact 2 facing away from the fixed contact 2. The drive shaft 11 slidably extends through the fixed piston 12 with the drive shaft 11 axially movable by an actuator (not shown) so as to drive the movable contact 2 toward and away from the fixed contact 1. A puffer cylinder 13 is slidably fitted on the fixed piston 12, and is connected to the drive shaft 11. The puffer cylinder 13 cooperates with the fixed piston 12 so as to form a puffer chamber 7 within the puffer cylinder 13. An outer cylinder 15 is mounted on the outer periphery of the puffer cylinder 13 to form a thermal puffer cylinder 8 around the outer periphery of the puffer cylinder 13. A cover 19 is provided on the outer surface of the movable contact 2 to cover the same, and a first insulating nozzle 5 is connected to the puffer cylinder 13 in a surrounding relationships with respect to the cover 19. The first insulating nozzle forms a first gas flow passage **18*a* for guiding the arc extinguishing gas from the puffer chamber 7 to an arc generating portion. A second insulating nozzle is connected to the outer cylinder 15 in a surrounding relationships with respect to the first insulating nozzle 5. The second insulating nozzle 6 forms a second gas flow passage 18*b* for guiding the arc extinguishing gas from the thermal puffer chamber 8 to the arc generating portion If necessary, a main fixed contact 3 may be provided around the fixed contact 1, in which case the outer cylinder 15 serves as a main movable contact which is brought into contact with the main fixed contact 3**, thereby supplying main electricity.

In the closed condition shown in FIG. 1, the puffer chamber 7 and the thermal puffer chamber 8 are in a non-compressed condition, and the arc extinguishing gas of a rated pressure is filled in these chambers 7 and 8.

Figure 2:
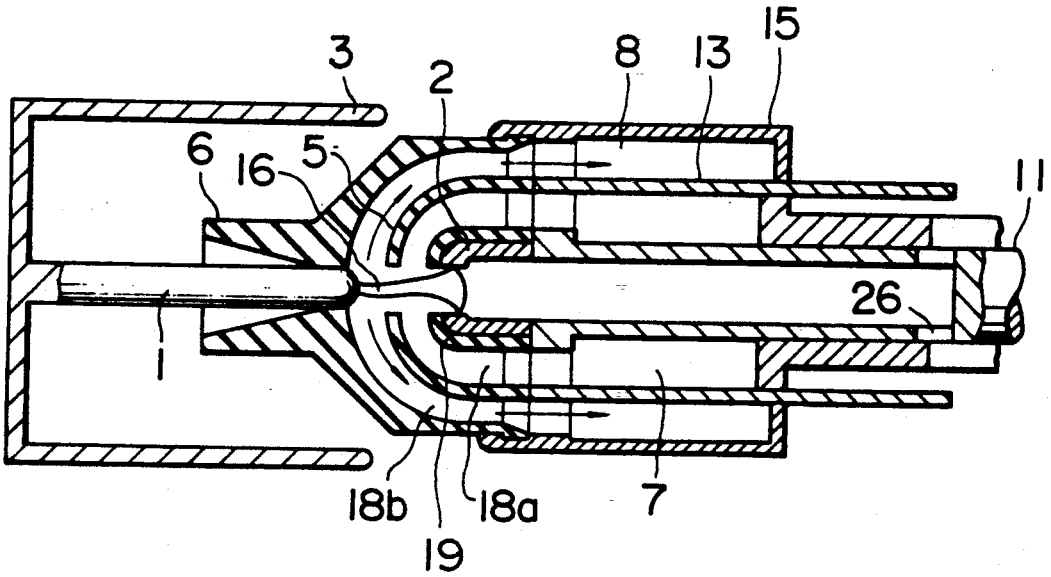
FIG. 2 is a longitudinal cross-sectional view of the first embodiment, showing in an intermediate stage of the interrupting operation.

When the drive shaft 11 is driven to the right in the drawings by the actuator (not shown), the movable contact 2 is moved apart from the fixed contact 1, so that an arc 16 is produced between these two contacts (FIG. 2). When the drive shaft 11 thus moves, the puffer cylinder 13 also moves right together with the drive shaft 11, so that the arc extinguishing gas within the puffer chamber 7 is compressed into a high pressure. At the same time, the arc extinguishing gas around the arc 16 is heated by the thermal energy of the arc 16 produced between the fixed contact 1 and the movable contact 2, so that a stream toward the thermal puffer chamber 8 is produced, and as a result the pressure within the thermal puffer chamber 8 rises to a high level. At this time, part of the heated arc extinguishing gas flows also into the puffer chamber 7; however, since the volume of the puffer chamber 7 is set to such a relatively small value so as to effect the interruption of medium and small electric current, a reaction force acting on the actuator via the puffer cylinder 13 is small, and therefore any adverse influence will not occur.

Figure 3:
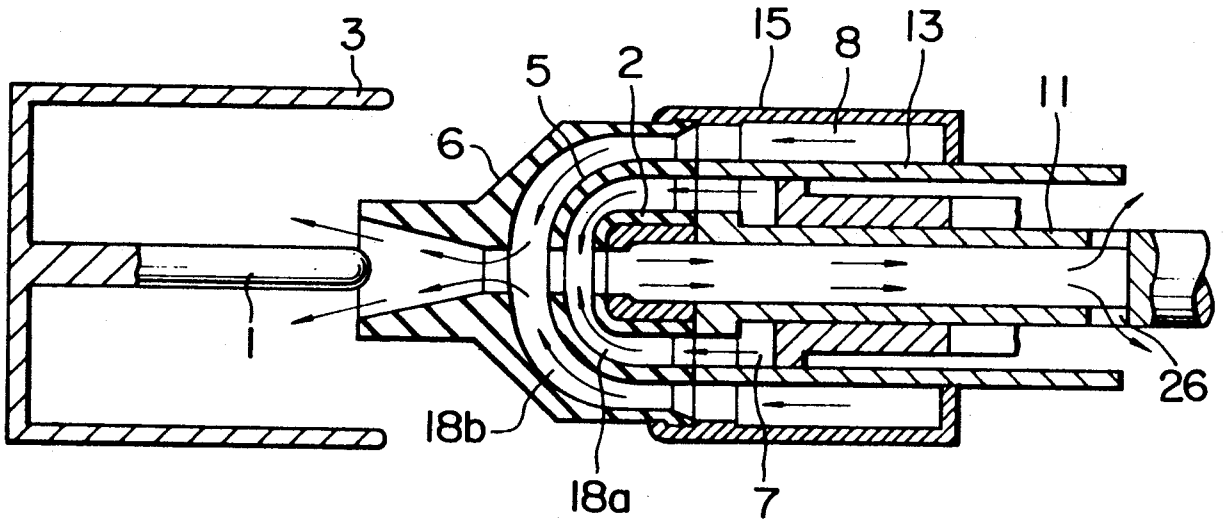
FIG. 3 is a longitudinal cross-sectional view of the first embodiment, in a final stage of the interrupting operation.

When the interrupting operation further proceeds to reach its final stage shown in FIG. 3, the fixed contact 1 is out of a throat portion of the second insulating nozzle 6. At this time, the arc extinguishing gas, having risen to the high pressure in connection with the movement of the drive shaft 11 for parting the contacts 1,2 rom each other, is fed from the puffer chamber 7, and is blown onto the arc 16 through the first gas flow passage **18*a*. Also, the arc extinguishing gas, heated and having risen to the high pressure by the thermal energy of the arc 16, is fed from the thermal puffer chamber 8, and is blown onto the arc 16**. As a result, the arc extinguishing operation is carried out.

Figure 4:
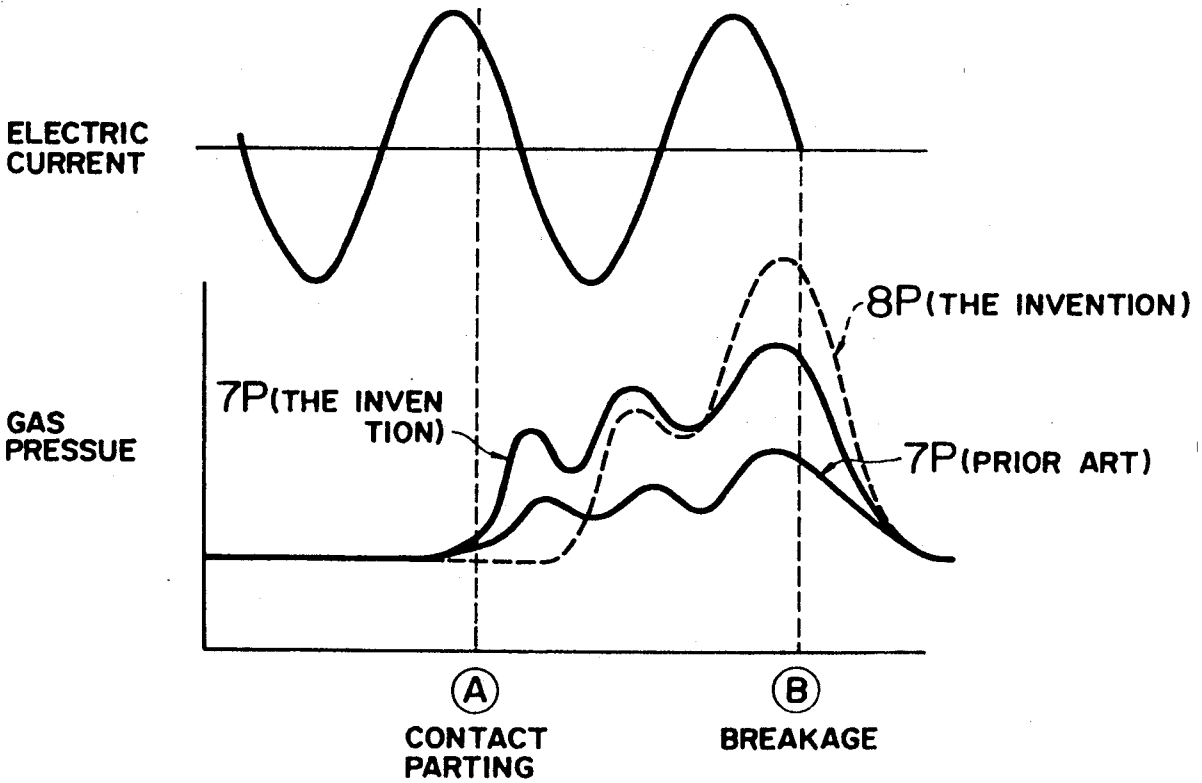
FIG. 4 is a graphical illustration of pressure rising characteristics of the first embodiment and a conventional puffer-type gas circuit breaker.

The pressure rising characteristics of the arc extinguishing gas in the puffer chamber 7 and the thermal puffer chamber 8 at this time are shown in FIG. 4. The second gas flow passage **18*b* communicated with the thermal puffer chamber 8 is disposed closer to the fixed contact 1 than the first gas flow passage 18*a* communicated with the puffer chamber 7. Therefore, the timing at which the arc extinguishing gas within the second gas flow passage 18*b* is brought into contact with the arc 16** is later than the timing at which the arc extinguishing gas within the first gas flow passage 18*a* is brought into contact with the arc 16. As a result, the pressure 8P within the thermal puffer chamber 8 increases later than the pressure 7P within the puffer chamber 7 increases. However, with the lapse of time, the pressure within the thermal puffer chamber 8 becomes higher than the pressure within the puffer chamber 7, and reaches a level required for the electric current interruption at an electric current interrupting (breakage) point B. On the other hand, the pressure 7P within the puffer chamber 7 is increased in a pulsating manner by the compression operation of the puffer cylinder 13 and the thermal energy of the arc 16 to reach a required level. As can be seen from FIG. 4, this pressure increase is higher than that achieved by the conventional puffer-type gas circuit breaker shown in FIG. 14. The reason for this is that the space of the puffer chamber 8 that can be utilized for the compression is not reduced even though the volume of the thermal puffer chamber 8 is increased.

As described above, in the puffer-type gas circuit breaker of the present invention, the puffer chamber 7 and the thermal puffer chamber 8 are provided independently of each other; therefore, the volumes of the puffer chamber 7 and the thermal puffer chamber 8 can be arbitrarily set. Namely, the electric current interrupting performance of the gas circuit breaker can be arbitrarily set. In addition, even if the volume of the thermal puffer chamber 8 is increased so as to deal with the large electric current interruption, the space of the puffer chamber 7 that can be utilized for the compression is not reduced; therefore, the electric current interrupting performance can be enhanced without lowering the pressure increasing characteristics of the puffer chamber 7. Further, since the volume of the puffer chamber 7 and more particularly, its pressure receiving area are not changed, the operating force for the interruption is not increased.

Next, the first gas flow passage 18*a* for guiding the arc extinguishing gas from the puffer chamber 7 to the arc generatign portion, as well as the second gas flow passage 18*b* for guiding the arc extinguishing gas from the thermal puffer chamber 8 to the arc generating portion, will now be described in detail with reference to FIG. 5.

Figure 5:
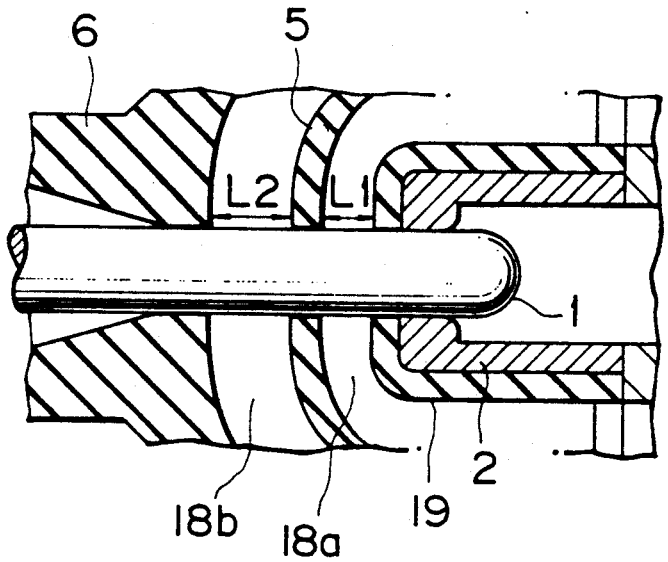
FIGS. 5 and 6 are enlarged cross-sectional views of a main portion of the puffer-type gas circuit breaker of the invention, showing first and second insulating nozzles.

As shown in FIG. 5, preferably, the distance L1 of the first gas flow passage 18*a* in the direction of the axis of the fixed contact 1 should be less than the distance L2 of the second gas flow passage 18*b* in the direction of the axis of the fixed contact 1. When the arc extinguishing gas around the contacts is heated and pressurized by the arc 16, streams of the arc extinguishing gas directed toward the puffer chamber 7 and the thermal puffer chamber 8 are produced. The stream of the arc extinguishing gas directed toward the puffer chamber 7 can be reduced by making the distance L1 of the first gas flow passage 18*a* smaller than the distance L2 of the second gas flow passage 18*b*. Namely, the influence of the arc on the pressure of the puffer chamber 7 can be reduced, and therefore the influence on the operating force of the drive shaft can be reduced.

Figure 6:
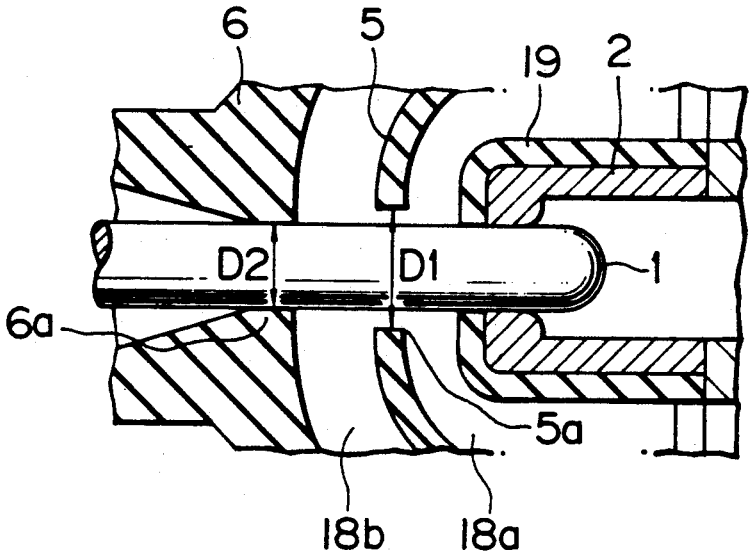

As shown in FIG. 6, the first insulating nozzle 5 and the second insulating nozzle 6 have their respective throat portions 5*a* and 6*a* surrounding the fixed contact 1. If the diameter D1 of the throat portion 5*a* is greater than the diameter D2 of the throat portion 6*a*, the arc extinguishing gas heated and pressurized by the arc 16 flows also into the thermal puffer chamber 8 through the throat portion 5*a* of the first insulating nozzle 5 during transient period from the time when the movable contact 2 moves apart from the fixed contact 1 to the time when the throat portion 5*a* moves out of the fixed contact 1. Therefore, even in this transient condition, the influence on the puffer chamber 7 can be reduced, and for this reason it is preferred that the diameter D1 of the throat portion 5*a* be greater than the diameter D2 of the throat portion 6*a*.

Figure 7:
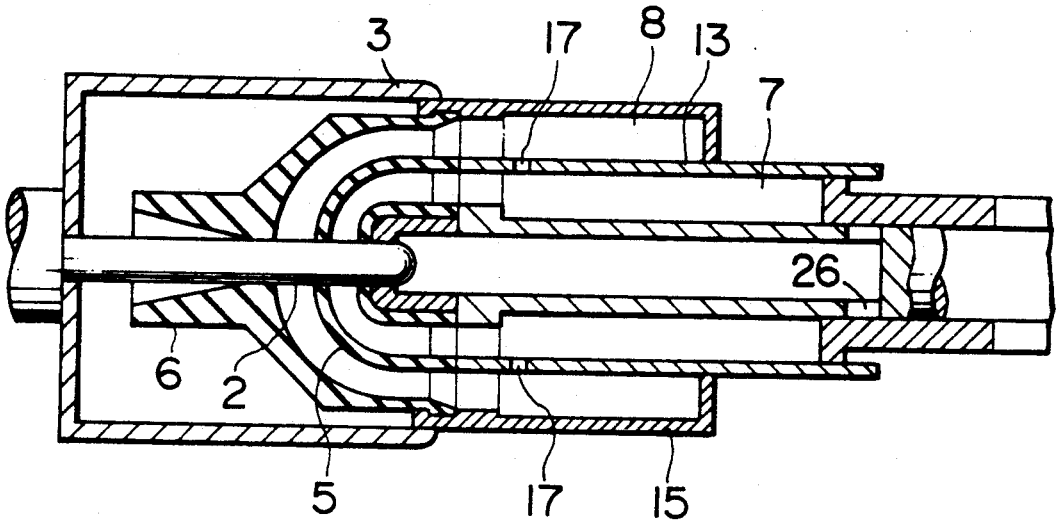
FIG. 7 is a longitudinal cross-sectional view of a second embodiment of a puffer-type gas circuit breaker according to the invention, in a closed condition of the gas circuit breaker.

A second embodiment of a puffer-type gas circuit breaker according to the present invention will now be described with reference to FIG. 7. In this second embodiment, small holes 17 are formed through a peripheral wall of a puffer cylinder 13, and a puffer chamber 7 and a thermal puffer chamber 8 are communicated with each other by the small holes 17. Except for this structure, the second embodiment is identical in construction to the first embodiment.

In the above-mentioned transient condition, arc extinguishing gas around an arc 16 is heated and pressurized, and flows into a puffer chamber 7. On the other hand, a thermal puffer chamber 8 has not yet been heated and pressurized by the arc 16, and therefore is in a relatively low pressure condition. Therefore, the arc extinguishing gas, flowing into the puffer chamber 7, flows into the thermal puffer chamber 8 through the small holes 17. Therefore, in the transient condition, the influence of the arc on the puffer chamber 7 can be reduced, and the influence on the operating force of the drive shaft can be reduced.

Figure 8:
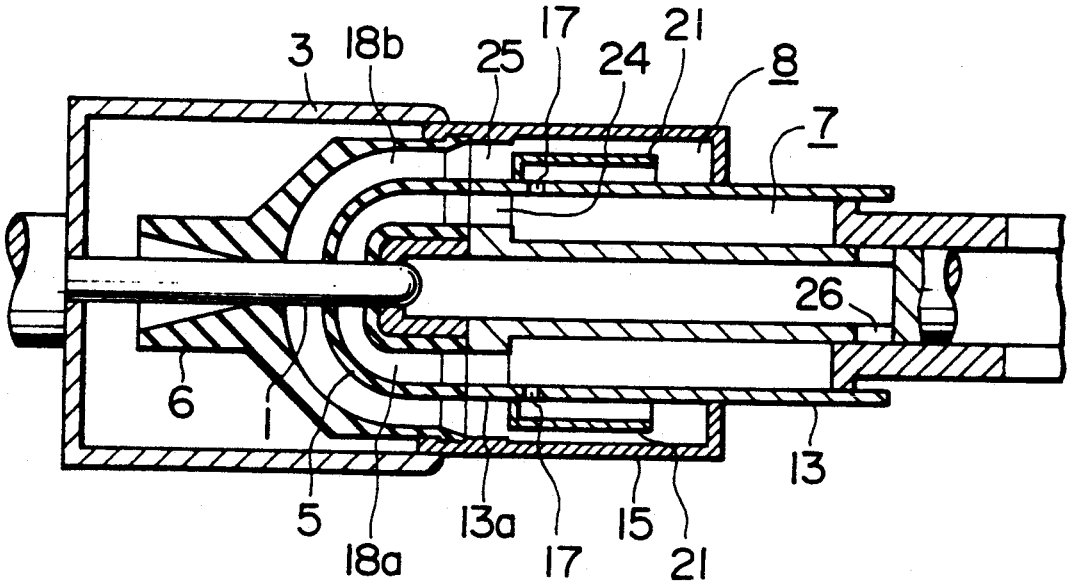
FIG. 8 is a longitudinal cross-sectional view of a modification of the second embodiment.

FIG. 8 shows a modification of the second embodiment. In this modification, cooling fins 21 are provided within the thermal puffer chamber 8, and are disposed adjacent to the small holes 17. The cooling fins 21 cool the arc extinguishing gas flowing into the thermal puffer chamber 8 through the small holes 17.

When asymmetrical electric current caused by some accident is to be interrupted, the arc to be produced is of a high intensity. Therefore, the arc extinguishing gas around the arc is heated by the arc to a very high temperature, and flows into the thermal puffer chamber 8. The arc extinguishing gas of a very high temperature thus flows into the thermal puffer chamber 8 is cooled by the cooling fins 21 to an appropriate temperature. This prevents the arc extinguishing gas within the thermal puffer chamber 8 from being decomposed by the high temperature, thereby preventing the arc extinguishing gas from being deprived of the extinguishing property.

Figure 9:
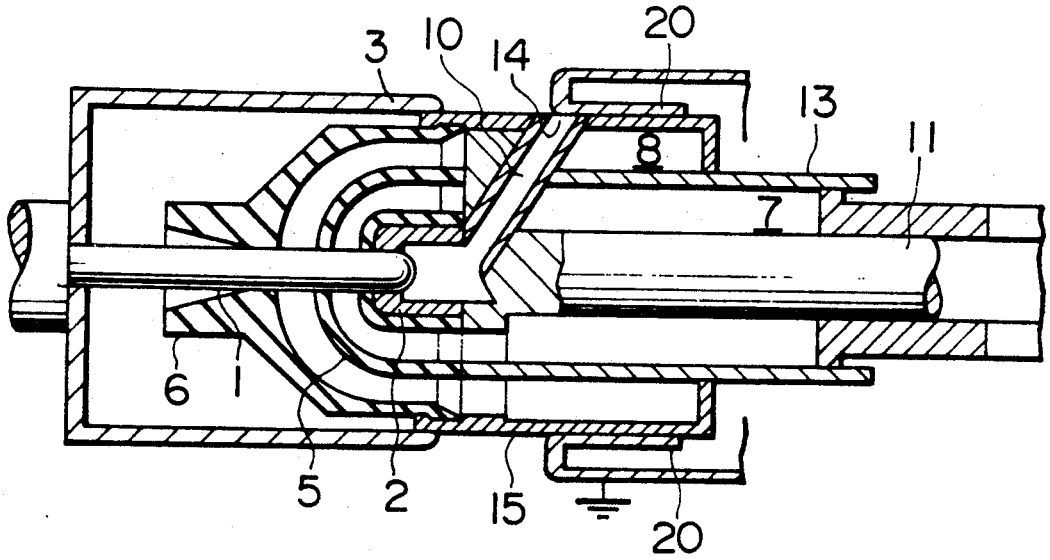
FIG. 9 is a longitudinal cross-sectional view of a third embodiment of a gas circuit breaker according to the invention, in a closed condition of the gas circuit breaker.

FIG. 9 shows a third embodiment of a puffer-type gas circuit breaker according to the present invention. In this third embodiment, a drive shaft 11 is almost solid, and there are provided a plurality of gas discharge passages 10 (only one of which is shown in FIG. 9) communicating a hollow portion of a movable contact 2 with the exterior of an outer cylinder 15. A discharge guide 20 is provided at outlets 14 of the gas discharge passages 10. The discharge guide 20 closes the outlets 14 when the circuit breaker in a closed condition, and opens the outlets 14 when a throat portion of a second insulating nozzle 6 comes out of a fixed contact 1.

Figure 14:
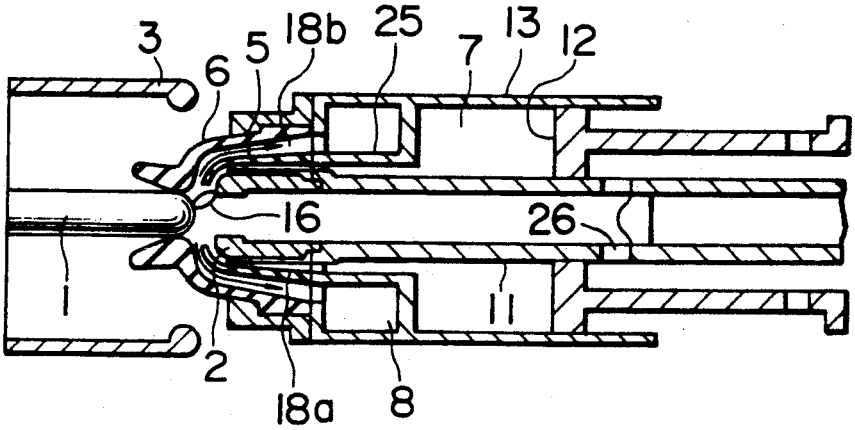
FIG. 14 PRIOR ART
FIG. 14 is a longitudinal cross-sectional view of a conventional puffer-type gas circuit breaker.

In the conventional puffer-type gas circuit breaker of FIG. 14 and the puffer-type gas circuit breakers of the first and second embodiments of the invention, the arc extinguishing gas, used for extinguishing the arc and passed through the interior of the movable contact 2, is discharged through a gas discharge passage formed in the interior of the drive shaft 11. In the third embodiment, however, the arc extinguishing gas passed through the interior of the movable contact 2 is discharged through the plurality of gas discharge passages 10. As compared with the gas discharge passage in the drive shaft 11, the gas discharge passages 10 are shorter, and the total flow area of these discharge passages 10 are larger, and therefore the flow resistance offered by the gas discharge passages 10 is reduced, and the gas discharge efficiency is enhanced. In addition, since the drive shaft 11 is solid, the diameter of the drive shaft 11 can be reduced because of its increased strength, and therefore the overall diameter of the circuit breaker can be reduced.

Next, the first and second insulating nozzles will be described.

Figure 10:
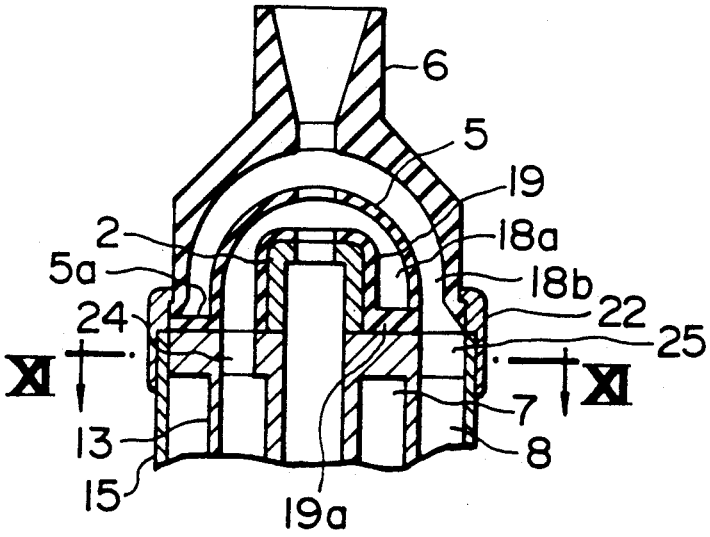
FIG. 10 is a cross-sectional view of first and second insulating nozzles taken along the line X—X in FIG. 11.
Figure 11:
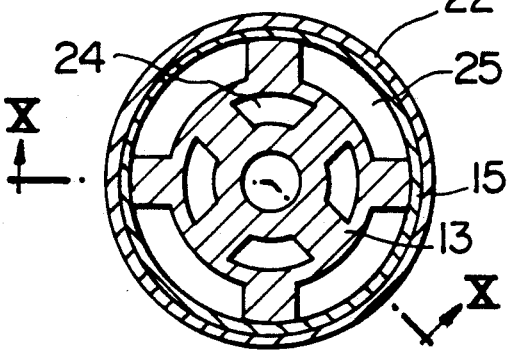
FIG. 11 is a cross-sectional view taken along the line XI—XI of FIG. 10.

Referring to FIG. 10, the cover 19 is provided to cover the outer surface of the movable contact 2, and the first insulating nozzle 5 is provided to form the first gas flow passage 18*a* outside the cover 19. The second insulating nozzle 6 is provided to form the second gas flow passage 18*b* outside the first insulating nozzle 5. The cover 19 has a leg portion 19*a*, and the first insulating nozzle 5 is arranged in such a manner that the lower end of the first insulating nozzle 5 is placed on the leg portion 19*a*. The first insulating nozzle 5 has a leg portion 5*a*, and the second insulating nozzle 6 is arranged in such a manner that the lower end of the second insulating nozzle 6 is placed on the leg portion 5*a*. The second insulating nozzle 6 is fastened to the outer cylinder 15 by a metal holder 22. In this case, as shown in FIG. 11, it is necessary that each communication hole 24 communicating the puffer chamber 7 with the first gas flow passage 18*a* should be displaced 45° with respect to a communication hole 25 communicating the thermal puffer chamber 8 with the second gas flow passage 18*b*.

With the above construction, the cover 19 and the first and second insulating nozzles 5 and 6 can be fixed only by the metal holder 22; therefore, the assembling is easy.

Figure 12:
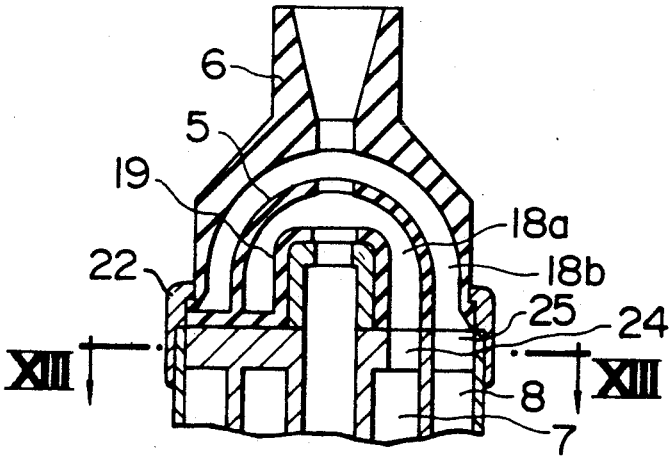
FIG. 12 is a view similar to FIG. 10, but showing modified first and second insulating nozzles taken along the line XII—XII in FIG. 13
Figure 13:
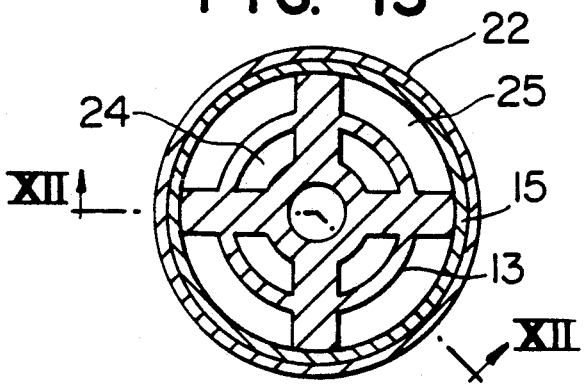
FIG. 13 is a cross-sectional view taken along the line XIII—XII of FIG. 12.

FIGS. 12 and 13 show a further embodiment of the invention in which the cover 19, the first insulating nozzle 5 and the second insulating nozzle 6 are integrally molded into a unitary member.

With this construction, a variation in the positioning of the nozzles relative to each other is reduced, and the position of generation of the arc can be specified. Therefore, the blowing of the arc extinguishing gas onto the arc can be effected more positively, thereby enhancing the interrupting performance and facilitating assembly.

As described above, in the puffer-type gas circuit breakers according to the present invention, the thermal puffer chamber is independently formed on the outer periphery of the puffer cylinder, and therefore the volume of the thermal puffer chamber can be set arbitrarily in accordance with the value of the interrupting current, without lowering the pressure increasing characteristics of the puffer chamber.

What is claimed is:

1. A puffer-type gas circuit breaker comprising:

arc extinguishing gas filled in an interior of said gas circuit breakers;

a fixed contact;

a movable contact disposed in an opposed relationship with respect to said fixed contact so as to come into contact with said fixed contact;

a fixed piston;

a drive shaft slidably extending through said fixed piston and being adapted to drive said movable contact toward and away from said fixed contact;

a puffer cylinder slidably fitted on said fixed piston, said puffer cylinder cooperating with said fixed piston to define a puffer chamber within said puffer cylinder;

an outer cylinder mounted on an outer periphery of said puffer cylinder to form a thermal puffer chamber outside said puffer cylinder;

a cover covering an outer surface of said movable contact;

a first insulating nozzle surrounding said cover to form a first gas flow passage for guiding the arc extinguishing gas from said puffer chamber to an arc generating portion and having a throat portion surrounding said fixed contact; and a second insulating nozzle surrounding said first insulating nozzle to form a second gas flow passage for guiding the arc extinguishing gas from said thermal puffer chamber to said arc generating portion and having a throat portion surrounding said fixed contact.

2. A puffer-type gas circuit breaker according to claim 1, wherein a distance of said first gas flow passage in a direction of an axis of said fixed contact is less than a distance of said second gas flow passage in the direction of the axis of said fixed contact.

3. A puffer-type gas circuit breaker according to claim 1, wherein a diameter of said throat portion of said first insulating nozzle is greater than a diameter of said throat portion of said second insulating nozzle.

4. A puffer-type gas circuit breaker according to one of claims 1, 2 or 3, wherein small holes for communicating said puffer chamber with said thermal puffer chamber are formed through a peripheral wall of said puffer cylinder.

5. A puffer-type gas circuit breaker according to claim 4, wherein a cooling fin is provided within said thermal puffer chamber, said cooling fin being disposed adjacent to said small holes.

6. A puffer-type gas circuit breaker according to one of claims 1, w or 3, wherein a plurality of gas discharge passages communicate with an interior of said movable contact with an exterior of said outer cylinder, a discharge guide is provided at outlets of said gas discharge passages, and wherein said discharge guide closes said outlets until ad throat portion of said second insulating nozzle is moved out of said fixed contact.

7. A puffer-type gas circuit breaker according to claim 4, a plurality of gas discharge passages communicate with an interior of said movable contact with an exterior of said outer cylinder, a discharge guide is provided at outlets of said gas discharge passages, and wherein said discharge guide closes said outlets until said throat portion of said second insulating nozzle is moved out of said fixed contact.

8. A puffer-type gas circuit breaker according to claim 5, a plurality of gas discharge passages communicate with an interior of said movable contact with an exterior of said outer cylinder, a discharge guide is provided at outlets of said gas discharge passages, and wherein said discharge guide closes said outlets until said throat portion of said second insulating nozzle is moved out of said fixed contact.

9. A puffer-type gas circuit breaker according to one of claims 1, 2 or 3, wherein said cover, said first insulating nozzle and said second insulating nozzle are integrally molded into a unitary construction adapted to be secured to the outer cylinder.

10. A puffer-type gas circuit breaker according to claim 4, wherein said cover, said first insulating nozzle and said second insulating nozzle are integrally molded into a unitary construction adapted to be secured to the outer cylinder.

11. A puffer-type gas circuit breaker according to claim 5, wherein said cover, said first insulating nozzle and said second insulating nozzle are integrally molded into a unitary construction adapted to be secured to the outer cylinder.

12. A puffer-type gas circuit breaker according to claim 6, wherein said cover, said first insulating nozzle and said second insulating nozzle are integrally molded into a unitary construction adapted to be secured to the outer cylinder.

13. An insulating nozzle for a puffer-type gas circuit breaker including a puffer chamber and a thermal puffer chamber, said insulating nozzle comprising:

a cover an outer surface of a movable contact;

a first insulating nozzle surrounding said cover to form a first gas flow passage for guiding an arc extinguishing gas from said puffer chamber to an arc generating portion; and a second insulating nozzle surrounding said first insulating nozzle so as to form a second gas flow passage for guiding the arc extinguishing gas from said thermal puffer chamber to said arc generating portion, and wherein said cover, said first insulating nozzle and said second insulting nozzle are integrally molded into a unitary construction.

14. A puffer-type gas circuit breaker according to claim 7, wherein said cover, said first insulating nozzle and said second insulating nozzle are integrally molded into a unitary construction adapted to be secured to the outer cylinder.

15. A puffer-type gas circuit breaker according to claim 8, wherein said cover, said first insulating nozzle and said second insulating nozzle are integrally molded into a unitary construction adapted to be secured to the outer cylinder.

* * * * *